US006422199B1

(12) United States Patent
Buckley et al.

(10) Patent No.: US 6,422,199 B1
(45) Date of Patent: Jul. 23, 2002

(54) FUEL INJECTOR

(75) Inventors: Paul Buckley, Rainham; Malcolm David Dick Lambert, Bromley, both of (GB)

(73) Assignee: Delphi Technologies, Inc., Troy, MI (US)

( * ) Notice: Subject to any disclaimer, the term of this patent is extended or adjusted under 35 U.S.C. 154(b) by 36 days.

(21) Appl. No.: 09/648,925

(22) Filed: Aug. 25, 2000

(30) Foreign Application Priority Data

Aug. 26, 1999 (GB) ..... 9920144

(51) Int. Cl.[7] ..... F02B 3/00
(52) U.S. Cl. ..... 123/299; 123/467; 239/444
(58) Field of Search ..... 123/467, 299, 123/300, 303; 239/444, 446, 533.2, 533.3, 533.4, 533.5–533.12

(56) References Cited

U.S. PATENT DOCUMENTS 2,002,134 A * 5/1935 Baj ..... 123/467
3,764,076 A 10/1973 Eblen
4,356,976 A 11/1982 Eblen
4,499,862 A * 2/1985 Baumer et al. ..... 123/1 A

FOREIGN PATENT DOCUMENTS

DE 41 15 478 A1 11/1991

* cited by examiner

*Primary Examiner*—Willis R. Wolfe
*Assistant Examiner*—Mahmoud Gimie
(74) *Attorney, Agent, or Firm*—Thomas N. Twomey

(57) ABSTRACT

The present invention provides a fuel injector comprising a nozzle body within which first and second valve needles are slidable. The first valve needle is engagable with a first seating to control fuel injection from a first outlet opening provided in the nozzle body and the second valve needle is engagable with a second seating to control fuel injection from a second outlet opening provided in the nozzle body. The fuel injector further comprises first and second control chambers for fuel, whereby fuel pressure within the first and second control chambers controls movement of the first and second valve needles away from their respective seatings so as to permit fuel delivery from a selected outlet opening. The first and second valve needles being arranged adjacent to one another.

17 Claims, 9 Drawing Sheets

FUEL INJECTOR

TECHNICAL FIELD

This invention relates to a fuel injector for use in supplying fuel under pressure to a combustion space of an internal combustion engine. In particular, the invention relates to a fuel injector in which a characteristic of the fuel injector can be altered, in use.

BACKGROUND OF THE INVENTION

In order to reduce the levels of noise and particulate emissions produced by an engine it is desirable to provide an arrangement whereby the injection characteristics of fuel delivered to the engine can be controlled. For example, it may be desirable to be able to adjust the spray pattern formed by the delivery of fuel by an injector or to adjust the rate of fuel injection. British Patent Application GB 2 307 007 A and European Patent Application EP 0 713 004 A describe fuel injectors of the type in which the fuel injection characteristic can be varied, in use, by selecting different sets of fuel injector outlet openings provided in the fuel injector nozzle body. In both of these fuel injector designs, by controlling angular motion of a sleeve member, housed within the nozzle body, apertures formed in the sleeve are caused to align with selected ones of the outlet openings. Subsequent inward, axial movement of a valve member within the bore of the nozzle body causes fuel to be ejected from the selected outlet openings. Fuel injectors of this type do, however, have performance limitations.

Additionally, European Patent Application No. 00301922.1 describes a fuel injector including a nozzle body defining a bore within which an outwardly opening, outer valve member is slidable. Movement of the outer valve member in an outward direction causes fuel to be ejected from an upper group of outlet openings provided in the outer valve member. The outer valve member defines a blind bore within which an inner valve needle is slidable. Inward movement of the inner valve needle causes fuel injection through a lower group of outlet openings provided in the outer valve member. The fuel injection rate is controlled by means of an actuator arrangement which controls the downward force applied to the inner valve needle. A fuel injector of this type does, however, suffer from the disadvantages of outwardly opening fuel injectors. For example, a poor spray characteristic is obtained as the outlet openings become exposed and, in addition, fuel leakage can occur from the outlet openings during undesirable stages of the fuel injection cycle.

U.S. Pat. No. 5,588,412 describes a fuel injector of the inwardly opening type including a nozzle body provided with outlet openings which occupy different axial positions. Fuel injection through different ones of the outlet openings is selected by controlling axial movement of a spool valve. However, the fuel injector has the disadvantage that a high rate of fuel leakage through the outlet openings can occur during undesirable stages of fuel injector operation.

SUMMARY OF THE INVENTION

It is an object of the present invention to provide an alternative fuel injector which enables the fuel injection characteristics to be varied, in use and which alleviates at least some of the disadvantages of known fuel injectors having this capability.

According to the present invention, there is provided a fuel injector comprising a nozzle body having a bore therein, within which first and second valve needles are slidable, the first valve needle being engagable with a first seating to control fuel injection from a first outlet opening provided in the nozzle body, the second valve needle being engagable with a second seating to control fuel injection from a second outlet opening provided in the nozzle body, the fuel injector further comprising first and second control chambers for fuel, whereby fuel pressure within the first and second control chambers controls movement of the first and second valve needles away from their respective seatings so as to permit fuel delivery from a selected outlet opening, the first and second valve needles being arranged adjacent to one another.

As fuel injection occurs when the valve needles are moved inwardly, the fuel injector provides the advantage that leakage during undesirable stages of the fuel injection cycle is substantially avoided. Furthermore, an improved fuel spray is achieved compared to fuel injectors of the outwardly opening type. By controlling the fuel pressure within the first and second control chambers so as to move one or both of the valve needles away from their respective seatings, the fuel injection rate, or other fuel injection characteristics, can be varied, in use.

Preferably, the first and second valve needles may be arranged substantially in parallel within the nozzle body.

Conveniently, the first control chamber may be arranged such that fuel pressure within the first control chamber serves to bias the first valve needle against the first seating and serves to bias the second valve needle away from the second seating. Conveniently, the second control chamber may be arranged such that fuel pressure within the second control chamber serves to bias the first and second valve needles against their respective seatings.

In use, fuel pressure within the first and second control chambers may be controlled such that, when fuel pressure within the first control chamber is held at a high level and the pressure within the second control chamber is reduced to a chosen low pressure, only the second valve needle moves away from its seating. Alternatively, when fuel pressure within the first chamber is reduced to a low level prior to reducing the pressure within the second control chamber to the chosen low level, only the first valve needle moves away from its seating. From either of these conditions, modification of the fuel pressure within the first control chamber may result in both valve needles occupying lifted positions.

It will be appreciated that the pressure within the first control chamber is used to select which of the needles will move, and the pressure within the second control chamber is used to control the timing of commencement and termination of injection.

The fuel injector may be constructed such that in use, when the fuel pressure within the first control chamber is at a relatively high level and fuel pressure within the second control chamber is reduced from a further relatively high level to a further relatively low level, only the second valve needle moves away from its seating to allow fuel to flow through the second outlet opening only.

Additionally, the fuel injector may be constructed such that, in use, when the second valve needle is lifted away from the second seating with fuel pressure within the first control chamber at the relatively high level, a reduction in fuel pressure within the first control chamber from the relatively high level to a relatively low level also causes the first valve needle to move away from the first seating.

Alternatively, or in addition, the fuel injector may be constructed such that, in use, when fuel pressure within the first control chamber is reduced from a relatively high level to a relatively low level, and fuel pressure within the second control chamber is subsequently reduced from a further relatively high level to a further relatively low level, only the first valve needle moves away from its seating.

The fuel injector may also be constructed so that in use, following a reduction in fuel pressure within the first control chamber to the relatively low level and the reduction of fuel pressure within the second control chamber to the further relatively low level, an increase in fuel pressure within the first control chamber to the relatively high level causes the second valve needle to lift away from the second seating.

The first and second valve needles may be guided for sliding movement by means of first and second bores respectively provided in the nozzle body, the first and second bores being arranged side by side and defining flow paths for fuel towards the outlets.

Alternatively, sliding movement of the first and second valve needles may not be guided. This provides the advantage that the nozzle body may be formed with an increased wall thickness to permit fuel at higher pressure to be delivered to the bore.

The nozzle body may be a unitary component or may comprise an upper nozzle body part provided with an opening and a lower nozzle body provided with first and second blind bores arranged side by side, the lower nozzle body part being received in the opening to close an open end thereof, the first and second blind bores receiving a respective one of the first and second valve needles and defining the first and second seatings respectively. The provision of a nozzle body having upper and lower parts provides a manufacturing advantage.

Conveniently, the nozzle body defines a delivery chamber for fuel. The first and second outlet openings may be provided in the nozzle body such that fuel delivery through the first and/or second outlet opening occurs when the first and/or second valve needle uncovers the respective outlet opening. Alternatively, the first and second outlet openings may be provided in the nozzle body such that the first and second outlet openings communicate with first and second sac regions respectively located downstream of the first and second seatings respectively, fuel delivery through the first and/or second outlet opening thereby taking place when the first and/or second valve needle is lifted away from its seating and fuel flows from the delivery chamber to the respective sac region.

BRIEF DESCRIPTION OF THE DRAWINGS

The invention will now be described, by way of example only, with reference to the accompanying drawings in which.

DESCRIPTION OF THE PREFERRED EMBODIMENT

Figure 1:
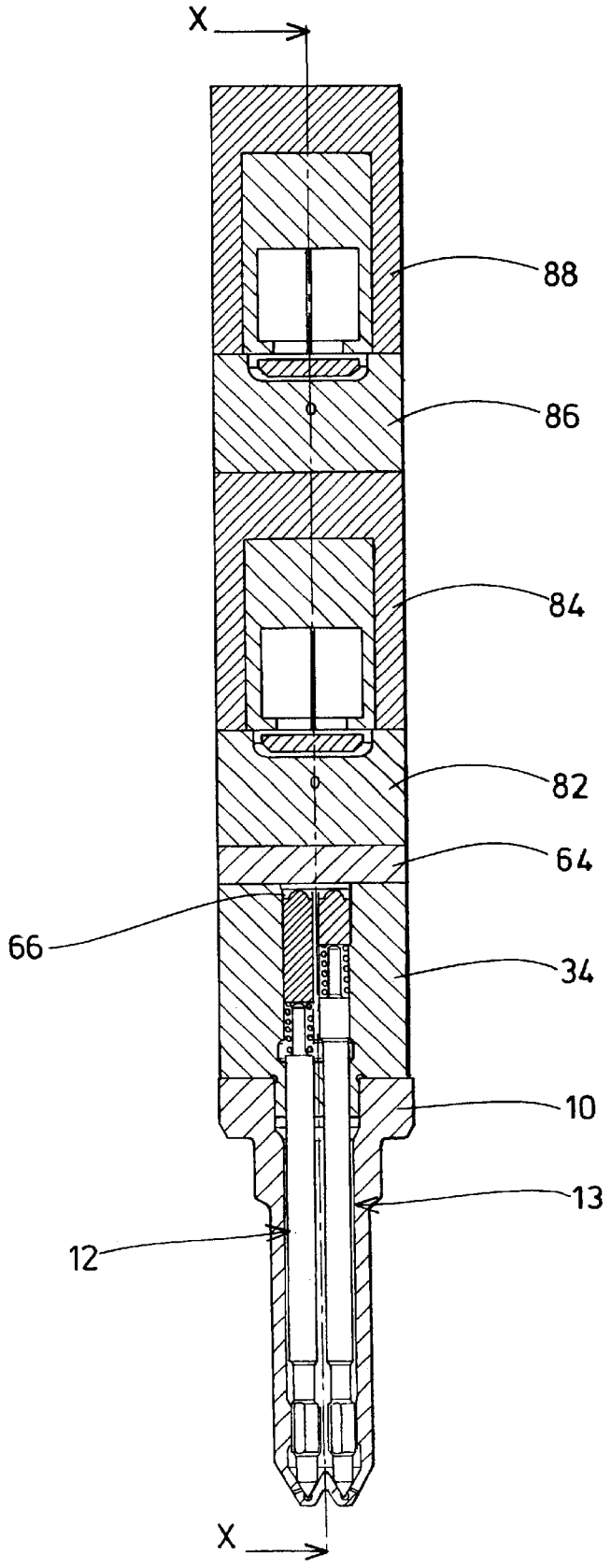
FIG. 1 is a sectional view of an embodiment of the fuel injector of the present invention.

Referring to FIGS. 1 to 4, the fuel injector includes a nozzle body 10 provided with a bore 11, and first and second valve needles, referred to generally as 12 and 13 respectively. The first and second valve needles 12, 13 are arranged side by side within the bore 11 and are slidable within the bore 11. The valve needle 12 includes an upper region 12*a*, a reduced diameter region 12*b*, an intermediate region 12*c* and a lower reduced diameter region 12*d*. Similarly, the valve needle 13 includes an upper region 13*a*, a reduced diameter region 13*b*, an intermediate region 13*c* and a lower reduced diameter region 13*d*. The valve needle 13 also includes an enlarged upper end region 13*e*.

The bore 11 is of blind form, the blind end of which is provided with first and second bores 16, 18 arranged in parallel and which extend through a nozzle body section 10*c*. The bores 16, 18 include intermediate regions of enlarged diameter which open into one another, forming a chamber 20, and include blind end regions defining first and second seating surfaces 22, 28 of frusto conical form. The blind bore 11 defines a delivery chamber 14 for fuel which communicates with the chamber 20 through the upper parts of the bores 16, 18. A tip portion 24 of the valve needle 12 is engagable with the first seating surface 22 to control fuel flow through a first set of outlet openings 26 provided in the nozzle body 10. A tip portion 30 of the valve needle 13 is engagable with the second seating surface 28 to control fuel flow through a second set of outlet openings 32 formed in the nozzle body 10. In use, inward movement of the valve needle 12 away from the first seating surface 22 controls fuel flow through the first set of outlet openings 26 and inward movement of the valve needle 13 away from the second seating surface 28 controls fuel flow through the second set of outlet openings 32.

Figure 4:
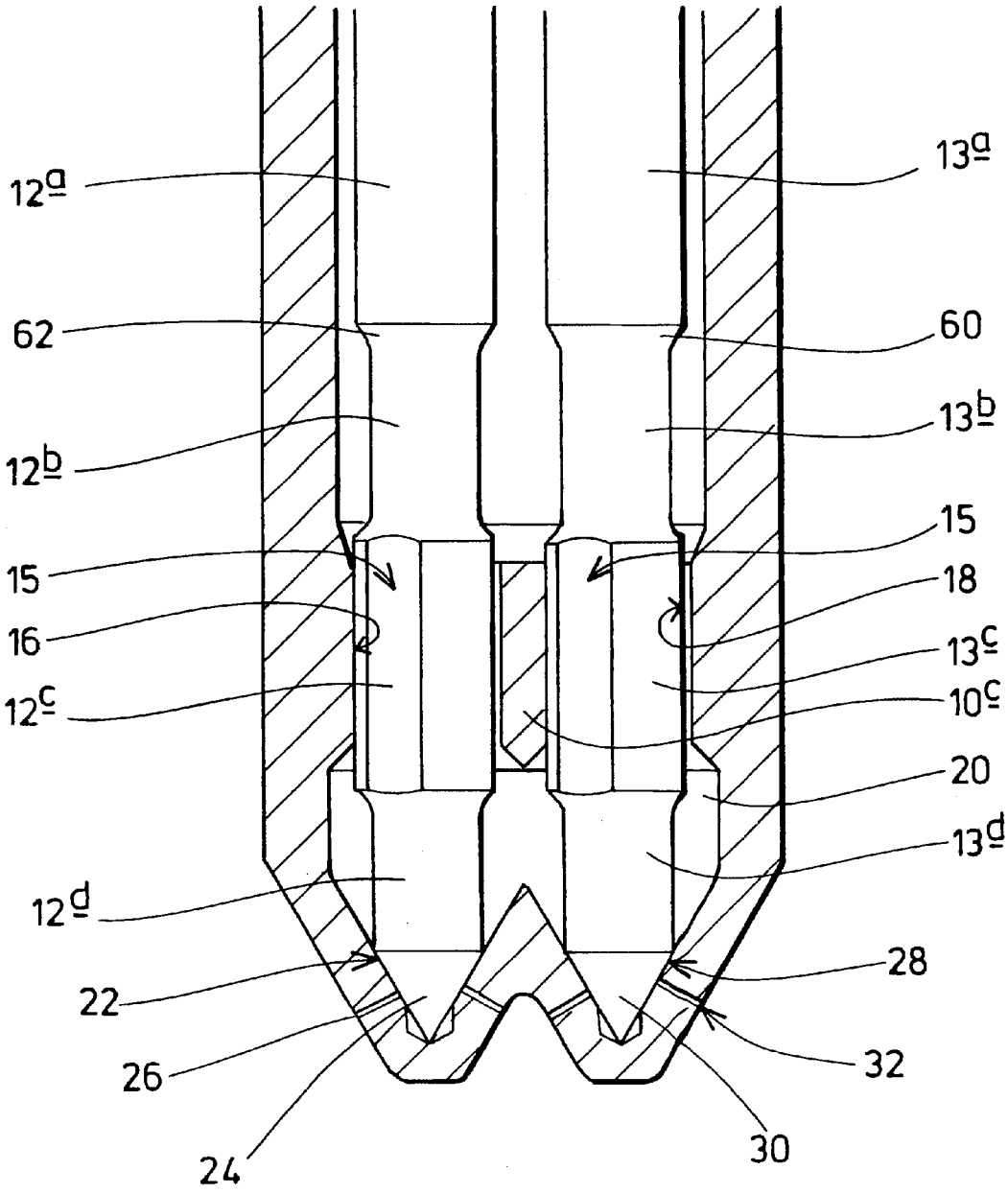
Figure 5:
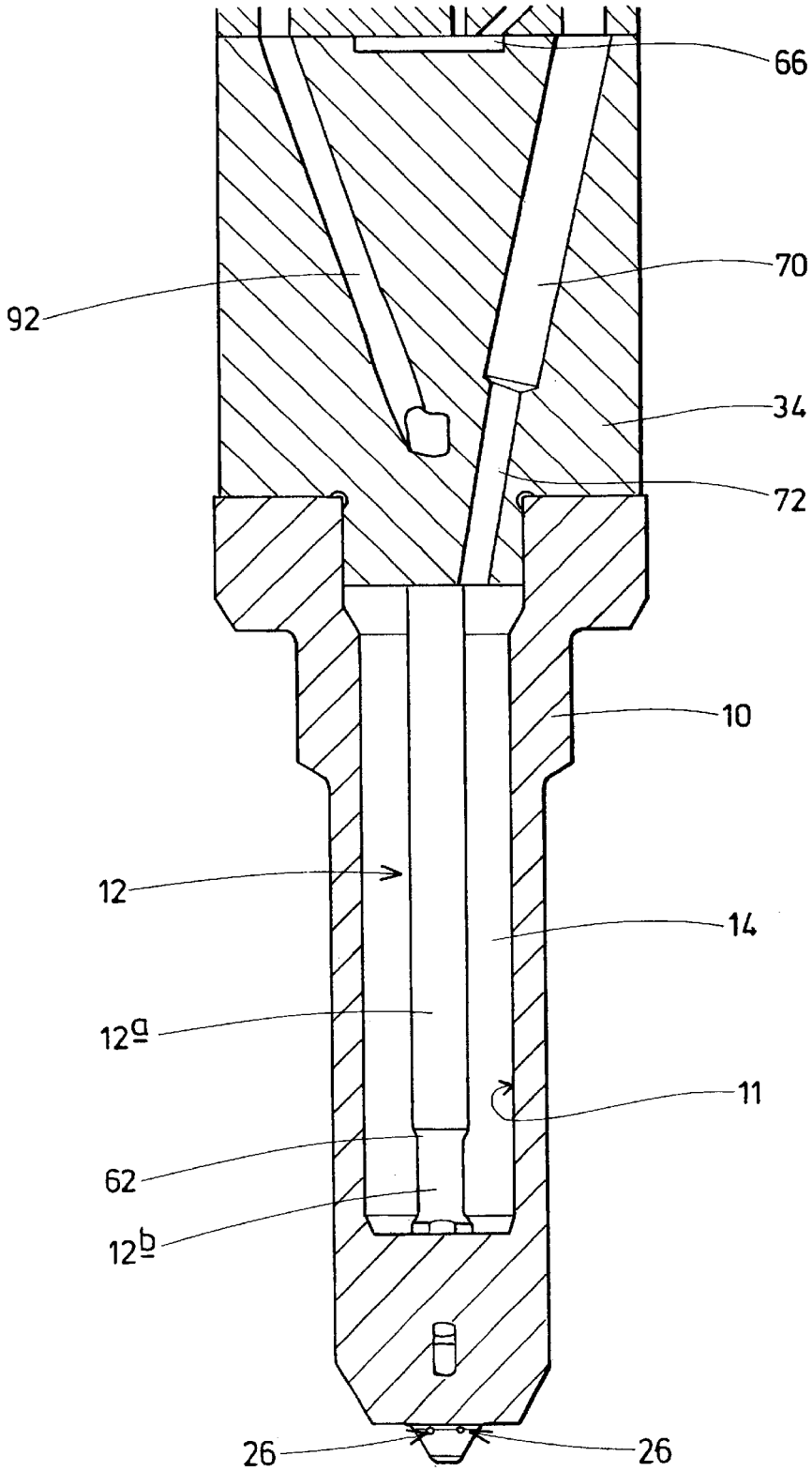
FIG. 5 is an enlarged view of the sectional view of the fuel injector in FIG. 2.

The diameters of the upper parts of the bores 16, 18 are substantially the same as the outer surface diameters of the intermediate valve needle regions 12*c*, 13*c* respectively such that the bores 16, 18 serve to guide sliding movement of the valve needle regions 12*c*, 13*c* respectively within the bores 16, 18. The valve needle regions 12*c*, 13*c* are provided with flats, slots or grooves 15 (as indicated in FIG. 4) which permit fuel in the delivery chamber 14 to flow into the chamber 20.

At the end of the nozzle body 10 remote from the first and second sets of outlet openings 26, 28, the nozzle body 10 abuts a distance piece 34 including a projecting region 34*a* which extends into the upper end of the bore 11. The distance piece 34 is provided with first and second through bores 36, 38, extending through the projecting region 34*a* of the distance piece 34, the bores 36, 38 being substantially coaxial with the bores 16, 18 respectively provided in the nozzle body section 10*c*. The diameters of the bores 36, 38 and the diameters of the adjacent parts of the valve needle regions 12*a*, 13*a* respectively are chosen so as to ensure that movement of the valve needles 12, 13 through the bores 36, 38 and the intermediate bores 16, 18 respectively during and after assembly is not hindered by any slight misalignment of the bores 16, 18. In order to minimise any such misalignment, dowels may be used in conventional manner.

The first bore 36 includes an enlarged diameter region 36*a* which communicates with an enlarged diameter region 38*a* of the second bore 38, the enlarged diameter bore regions 36*a*, 38*a* together defining a first control chamber 40. The bore 36 and the adjacent part of the valve needle region 12*a*, and the bore 38 and the adjacent part of the valve needle region 13*a*, together define a narrow clearance for fuel which permits fuel in the delivery chamber 14 to flow into the first control chamber 40 at a low rate. The bore 36 also defines a spring chamber 42 housing a compression spring 44 which abuts, at one end, the uppermost end face of the valve needle 12. The compression spring 44 serves to bias the valve needle 12 against the first seating surface 22 when the injector is not in use. The end of the compression spring 44 remote from the valve needle 12 abuts a piston member 46 which is slidable within a region 36*b* of the bore 36, the piston member 46 having a stop member 48 provided at its end remote from the spring 44. The bore 38 also defines a spring chamber 50 housing a second compression spring 52. The spring chamber 50 is in communication with a low pressure drain by means of a drilling (not shown).The spring 52 abuts the uppermost end face of the enlarged diameter valve region 13*e* and serves to bias the valve needle 13 against the second seating 28 when the injector is not in use. The end of the spring 52 remote from the valve needle 13 abuts a second piston member 54 which is slidable within an enlarged diameter region 38*b* of the bore 38, the piston member 54 including a stop member 56.

The diameter of the first bore 36 is chosen such that it is greater than the diameter of the first seating surface 22. Additionally, the diameter of the second bore 38 is arranged such that it is greater than the diameter of the second seating surface 28. As can be seen most clearly in FIG. 3, the diameter of the enlarged region 38*b* within which the piston member 54 is slidable is greater than the diameter of the region 36*b* of the bore 36 within which the piston member 46 is slidable. The regions 36*b*, 38*b* are of diameter greater than that of the lowermost parts of the bores 36, 38 respectively.

The valve needle 13 is provided with a first thrust surface 58, defined between the enlarged diameter region 13*e* and the valve needle region 13*a*, the first thrust surface 58 being exposed to fuel pressure within the first control chamber 40. The valve needle 13 is also provided with a second thrust surface 60, defined between the valve needle region 13*a* and the reduced diameter region 13*b*, the thrust surface 60 therefore being exposed to fuel pressure within the delivery chamber 14 and the chamber 20. The valve needle 12 is also provided with a thrust surface 62, defined between the valve needle region 12*a* and the reduced diameter region 12*b*, the thrust surface 62 also being exposed to the fuel pressure within the delivery chamber 14 and the chamber 20. Although these parts of the needles are identified as thrust surfaces, it will be appreciated that any appropriately angled surfaces of the needles will act as thrust surfaces, in use.

At the end of the distance piece 34 remote from the nozzle body, the through bores 36, 38 communicate with one another and define, together with a plate member 64 and the upper end faces of the piston members 46, 54, a second control chamber 66 for fuel. The stop members 48, 56 of the piston members 46, 54 respectively and the plate member 64 together define clearance gaps within the second control chamber which serve to limit the extent of upward movement of the valve needles 12, 13, in the position shown.

Figure 2:
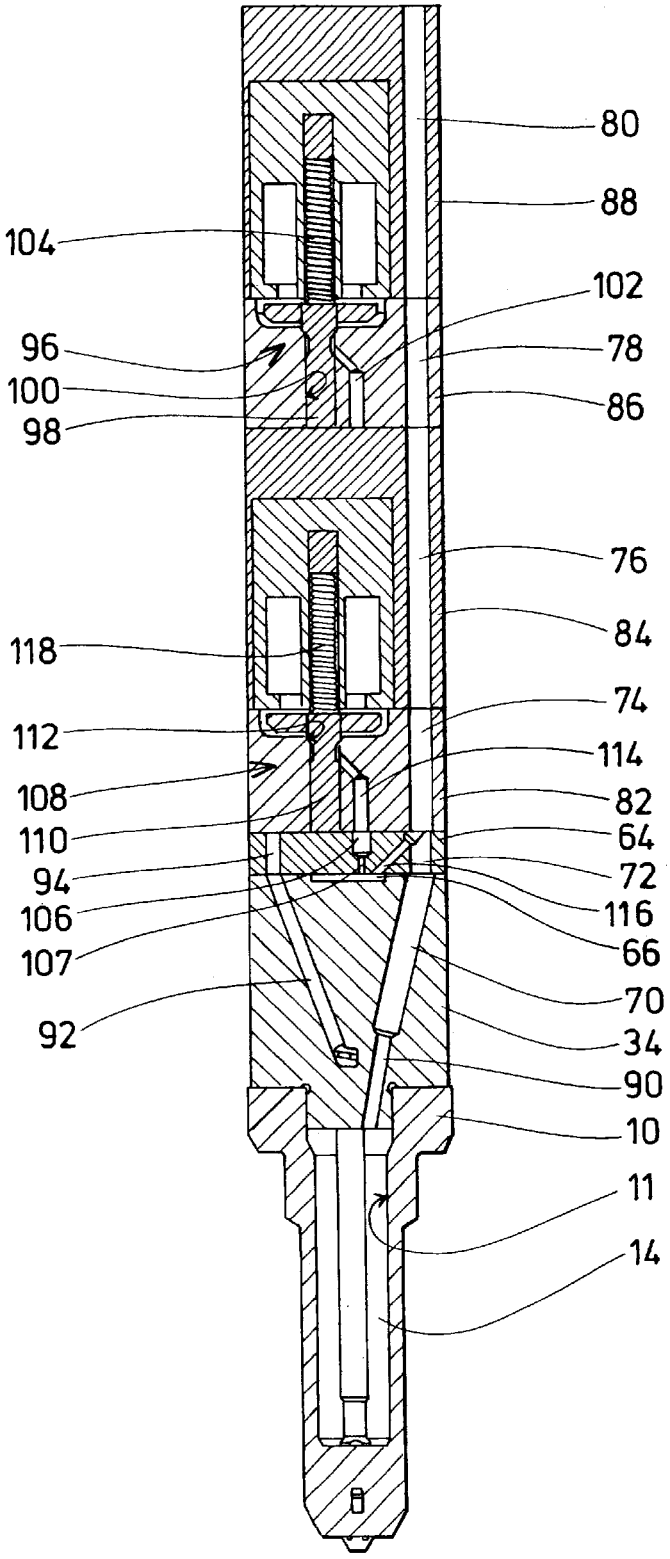
FIG. 2 is a sectional view along line X—X of the fuel injector in FIG. 1.
Figure 3:
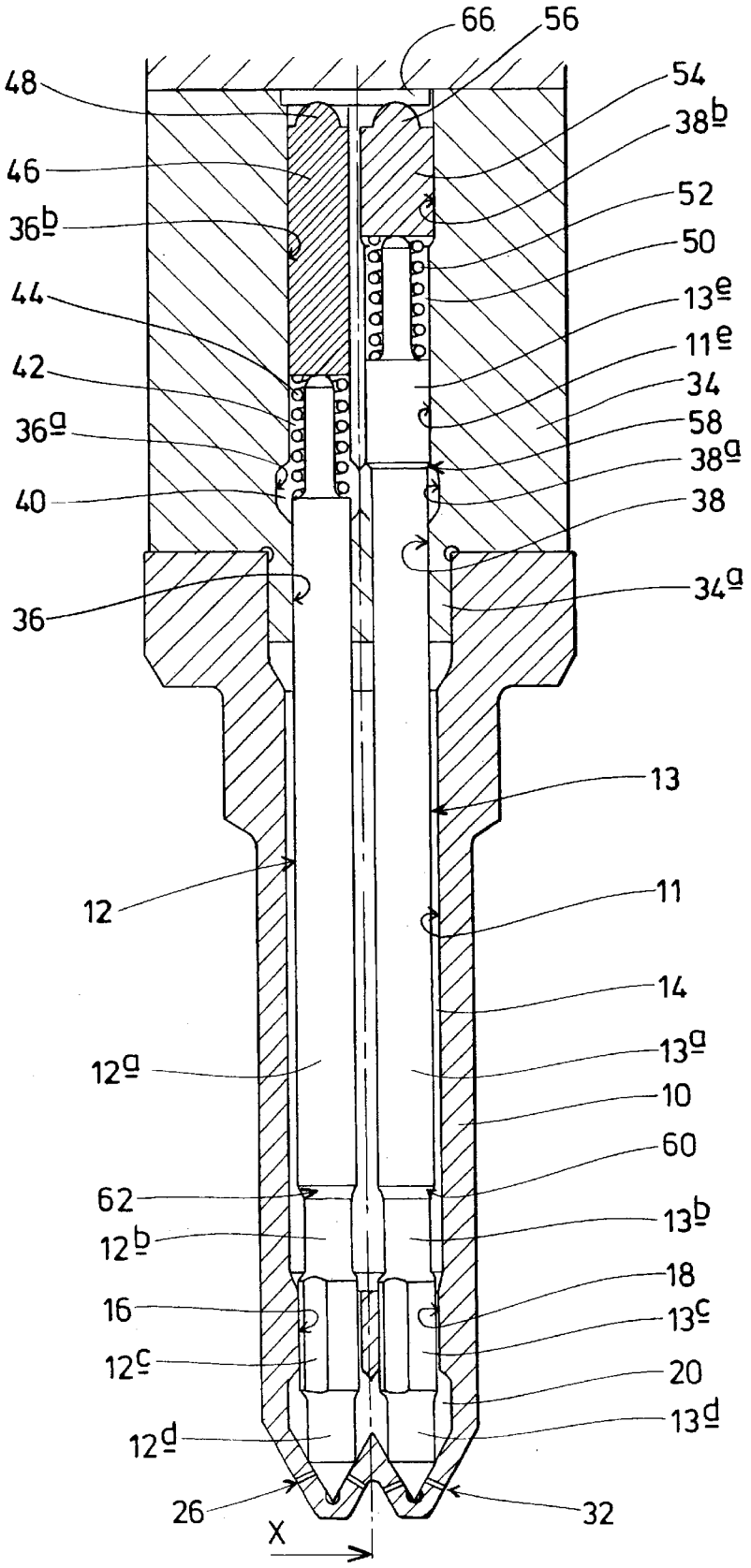
FIGS. 3 and 4 are enlarged views of the lower part of the fuel injector in FIG. 1.

As shown in FIG. 2, the distance piece 34 is provided with a first drilling which defines a supply passage 70 for fuel, the supply passage 70 communicating with a source of fuel at high pressure (not shown), for example a common rail of a common rail fuel system, the common rail being arranged to be charged to a suitably high pressure by an appropriate high pressure fuel pump so that high pressure fuel can be supplied to the delivery chamber 14. The supply passage 70 communicates with the source of fuel at high pressure by means of a drilling 72 provided in the plate member 64 and drillings 74, 76, 78, 80 provided in housing parts 82, 84, 86, 88 respectively. The supply passage 70 communicates with the delivery chamber 14 by means of an optionally restricted drilling 90 provided in the distance piece 34, the drilling 90 serving to limit the rate of fuel flow into the delivery chamber 14 from the supply passage 70.

The distance piece 34 is provided with a further drilling 92 which communicates with the first control chamber 40, the drilling 92 communicating, via a drilling 94 provided in the plate member 64 and other drillings (not shown), with a first control valve arrangement, referred to generally as 96 arranged in the housing parts 86, 88. The first control valve arrangement 96 includes a first valve member 98, slidable within a bore 100 defined in the housing part 86 and engagable with a first valve seating to control fuel flow to a low pressure fuel reservoir (not shown). In use, when the valve member 98 is moved away from its valve seating, fuel is able to flow from the first control chamber 40, via the drillings, through a passage 102 provided in the housing part 86, past the valve seating to the low pressure fuel reservoir. Movement of the valve member 98 may be controlled by means of an electromagnetic actuator 104, or any other suitable actuator, in a conventional way. The drilling 94 provided in the plate member 64 is of an appropriate dimension to limit the rate of flow of fuel from the first control chamber 40 to the low pressure fuel reservoir when the valve member 98 is moved away from its valve seating. Thus, in use, the first control valve arrangement 96 enables fuel pressure within the first control chamber 40 to be varied in a controlled manner.

Fuel pressure within the second control chamber 66 is controlled by means of a second control valve arrangement 108 which includes a second valve member 110. The second valve member 110 is slidable within a bore 112 provided in the housing part 82 and is engagable with a second valve seating to control fuel flow from the second control chamber 66 to a low pressure fuel reservoir (not shown). This may, for example, be the same low pressure fuel reservoir with which the first control chamber 40 communicates. When the second valve member 110 is moved away from its valve seating, fuel flows from the second control chamber 66, via drillings 106, 107, 114, to the low pressure fuel reservoir (not shown). Movement of the second valve member 110 away from its seating is controlled by means of an electromagnetic actuator 118, or any other suitable actuator, in a conventional way. When the second valve member 110 is moved away from its seating, fuel within the second control chamber 66 is able to flow past the second valve seating to the low pressure fuel reservoir. Thus, in use, the second control valve arrangement 108 enables fuel pressure within the second control chamber 66 to be varied.

The operation of the fuel injector, during various stages of the fuel injection cycle, will now be described. In use, with high pressure fuel supplied to the delivery chamber 14 through the supply passage 70 and the restricted passage 90, and with both the first and second control valve arrangements 96, 108 closed, fuel under high pressure is supplied to the second control chamber 66 via the drilling 116 and is supplied to the first control chamber 40 via leakage through the narrow clearances defined between the bores 36, 38 and the adjacent parts of the valve needle regions 12*a*, 13*a* respectively. As the first and second control valve arrangements 96, 108 are closed, fuel within the first and second control chambers 40, 66 is unable to escape to low pressure.

Figure 6:
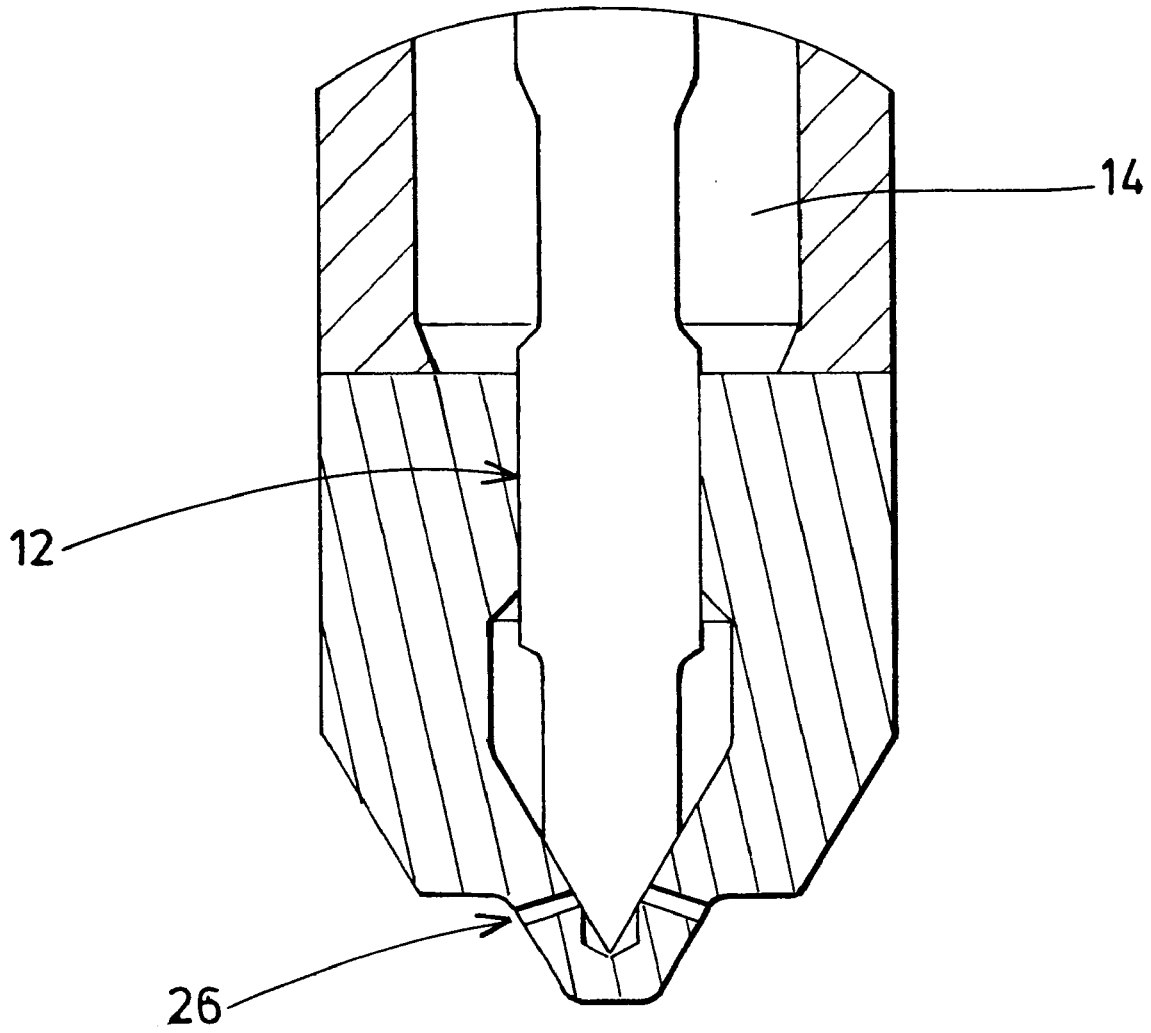
FIG. 6 is a sectional view of a part of the fuel injector in FIGS. 1–5, showing one of the valve needles in a non-fuel injecting position.

The effective area of the piston member 54 exposed to fuel within the second control chamber 66 is greater than the combined effective area of the thrust surface 58 provided on the valve needle 13, exposed to fuel within the first control chamber 40, and of the thrust surface 60 provided on the valve needle 13 exposed to fuel within the delivery chamber 14 and other surfaces of the needle 13. Thus, fuel pressure within the second control chamber 66 is sufficient to bias the valve needle 13 against the second seating surface 28, the load on the piston member 54 being transmitted directly to the valve needle 13. Additionally, the force resulting from the application of fuel under pressure to the end face of the valve needle region 12*a* combined with the force resulting from the application of fuel under pressure to the part of the piston member 46 exposed to fuel within the second control chamber 66, is greater than the force resulting from the application of fuel under pressure to the thrust surface 62 provided on the valve needle 12. Thus, fuel pressure within the first control chamber 40 serves to bias the valve needle 12 against the first seating surface 22. During this stage of operation, with both the valve needle 12 and the valve needle 13 seated against their respective seating surfaces 22, 28 and with the tip portions 24, 30 covering the first and second sets of outlet openings 26, 32, fuel is unable to flow past the seating surfaces 22, 28 and out through the first and second outlet openings 26, 32 into the engine cylinder. Thus, fuel injection does not take place. FIG. 6 shows the valve needle 12 during this stage of operation, with the tip portion 24 of the valve needle 12 covering the first outlet openings 26.

If it is desired to commence fuel injection through the second set of outlet openings 32, the second control valve arrangement 108 is actuated such that the second valve member 110 moves away from its valve seating to permit fuel flow from the second control chamber 66, through the drilling 106 and the drilling 114 to low pressure. The fuel pressure within the second control chamber 66 therefore decreases to a relatively low level, the upward force on the thrust surface 58 due to fuel pressure within the first control chamber 40 combined with the force on the thrust surface 60 due to fuel pressure within the delivery chamber 14 then being sufficient to overcome the force due to fuel pressure within the second control chamber 66. Thus, the valve needle 13 moves in an inwards direction and the tip portion 30 of the valve needle 13 is lifted away from the second seating surface 28 to uncover the second set of outlet openings 32. Fuel within the chamber 20, supplied from the delivery chamber 14, is therefore able to flow past the second seating surface 28 and out through the second set of outlet openings 32.

During this stage of operation, the control valve arrangement 96 is maintained in its closed position such that fuel in the first control chamber 40 is unable to flow to low pressure, thus ensuring that fuel delivery occurs only through the second set of outlet openings. Thus, although the first piston member 46 will move slightly in an upwards direction due to the reduced fuel pressure within the second control chamber 66, the fuel pressure within the first control chamber 40 remains at a relatively high level and the valve needle 12 remains biased in a downwards direction against the first seating surface 22. Fuel within the chamber 20 is therefore unable to flow past the first seating surface 22 and out through the first set of outlet openings 26. Thus, during this stage of operation, fuel injection only takes place through the second set of outlet openings 32.

Typically, the bore 38 may have a diameter of 1.9 mm, the second seating surface 28 may have a diameter of 1.5 mm, the bore region 11*e* may have a diameter of 2.2 mm, the bore region 38*b* may have a diameter of 2.5 mm, the bore 36 may have a diameter of 1.9 mm, the first seating surface 22 may have a diameter of 1.5 mm and the bore 36*b* may have a diameter of 2.0 mm. For a fuel injector having these dimensions, and with a fuel pressure within the delivery chamber 14 and the first control chamber 40 of 200 MPa, the valve needle 13 will move in an upwards direction when fuel pressure within the second control chamber 66 is reduced to around 85 MPa for a cylinder pressure of 10 MPa.

In order to cease fuel injection, the second control valve arrangement 108 is deactuated such that the valve member 110 returns to its seated position to close communication between the second control chamber 66 and the low pressure fuel reservoir. As fuel under high pressure is supplied to the second control chamber 66 via the drilling 116, high fuel pressure is therefore reestablished in the second control chamber 66. Fuel pressure within the second control chamber 66 acts on the second piston member 54, serving to bias the piston member 54 in a downwards direction against the action of the force on the thrust surfaces 58, 60 and the tip portion 30 of the valve needle 12 due to fuel pressure within the first control chamber 40 and the delivery chamber 14 respectively. When fuel pressure within the second control chamber 66 is sufficient to overcome the upward force applied to the thrust surfaces 58, 60, the valve needle 13 moves in a downward direction to seat the tip portion 30 of the valve needle 13 against the second seating surface 28. Thus, fuel in the chamber 20 is no longer able to flow past the second seating surface 28 out through the second set of outlet openings 32 covered by the tip portion 30 and fuel injection ceases. The effective area of the thrust surface 58 exposed to fuel pressure within the first control chamber 40 and the effective area of the end face of the piston member 54 exposed to fuel within the second control chamber 66 are selected such that the valve needle 13 is seated rapidly upon the second control valve arrangement 108 being closed.

Starting from a non-fuel injecting position, with both the valve needles 12, 13 seated against their respective seating surfaces 22, 28, in order to inject fuel through the first set of outlet openings 26 the first control valve arrangement 96 is actuated by the actuator 104 so as to move the first valve member 98 away from its valve seating. Fuel within the first control chamber 40 is therefore able to flow, through the various drillings, to the low pressure fuel reservoir and fuel pressure within the first control chamber 40 is reduced to a relatively low level. The piston member 46 is biased into contact with the valve needle 12 and fuel pressure within the second control chamber 66 is able to hold the valve needle 12 closed against the force due to fuel pressure acting on the thrust surface 62.

Following the reduction in fuel pressure within the first control chamber 40, the second control valve arrangement 108 is actuated such that the second valve member 110 is moved away from its valve seating to permit fuel within the second control chamber 66 to flow, via drillings 107, 106, 114, past the valve seating to the low pressure fuel reservoir. Thus, fuel pressure within the second control chamber 66 is also reduced. As fuel pressure within the second control chamber 66 is reduced the piston member 46 is able to move in an upwards direction under the action of the spring 42 and the force applied to the thrust surface 62. The valve needle 12 therefore moves in an upwards direction. The tip portion 24 of the valve needle 12 is therefore lifted away from the first seating surface 22 to uncover the first set of outlet openings 26 such that fuel in the chamber 20 is able to flow past the first seating surface 22 and out through the first set of outlet openings 26.

In order to ensure the valve needle 13 remains seated against the second seating surface 28 during this stage of operation, so that fuel injection only takes place through the first set of outlet openings 26, the injector is constructed so that, when the second control valve arrangement 108 is actuated such that fuel pressure within the second control chamber 66 is reduced to a relatively low level, the fuel pressure within the second control chamber 66 exerts a larger force on the piston member 54 than the combined force acting on the thrust surfaces 58, 60. As the pressure within the first control chamber 40 is reduced, it will be appreciated that this combined force is reduced. Thus, with fuel pressure within the second control chamber 66 reduced to a relatively low level, the valve needle 13 remains seated against the second seating surface 28. The drillings 116 and 107 are of a sufficiently small size to enable the fuel pressure within the second control chamber 66 to be held at a substantially constant low pressure level when the control valve arrangement 108 is open to low pressure. Thus, during this stage of operation, fuel injection only takes place through the first set of outlet openings 26. It will therefore be appreciated that the actuation of the first control valve arrangement 96 can be regarded as selecting that fuel injection should occur through the first set of outlet openings 26 only.

For a fuel injector having the dimensions described previously, a reduction in fuel pressure in the second control chamber 66 to around 70 MPa is sufficient to ensure the valve needle 13 remains biased in a downwards direction against its seating surface 28. As it is the dimensions of the drillings 116, 107, which govern the pressure within the second control chamber when the associated control valve is open, it will be appreciated that the pressure drop which occurs within the second control chamber during this mode of operation of the injector is substantially the same as when injection is to occur through the second set of outlet openings only.

From the position in which fuel injection only occurs through the first set of outlet openings 26, the first and second control valve arrangements 96, 108 respectively may both be closed such that fuel in the first and second control chambers 40, 66 is unable to escape to low pressure. Thus, the valve needle 13 remains biased against its seating surface 28 and the valve needle 12 is returned to its seated position under the action of the force applied to the first piston member 46 and the end face of the valve needle region 12*a* due to high fuel pressure within the second control chamber 66 and the first control chamber 40 respectively. Fuel injection is therefore ceased.

The injector may also be operated such that, starting from the position in which fuel injection only occurs through the second set of outlet openings 32, with fuel pressure within the second control chamber 66 at a relatively low level, the first control valve arrangement 96 is actuated by the actuator 104 such that fuel pressure within the first control chamber 40 is also reduced to a low level. At this stage, fuel pressure within the delivery chamber 14 acting on the thrust surface 62 and the reduced fuel pressure within the first control chamber 40 acting on the thrust surface 58 is sufficient to overcome the already reduced fuel pressure within the second control chamber 66. The valve needle 12 therefore moves in an upwards direction away from its seating surface 22 and fuel injection also occurs through the first set of outlet openings 26. Thus, during this stage of operation, the fuel injection rate is increased. The net effective area of the second needle 13 exposed to the fuel pressure within the first control chamber 40 is relatively small, and once moved to its open position, the effect of reducing the fuel pressure within the first control chamber 40 is insufficient to cause this needle to return to a closed position.

The injector may also be operated such that, starting from the position in which fuel injection is occurring only through the first set of outlet openings 26, actuation of the first control valve arrangement 96 to increase the fuel pressure within the first control chamber 40 will also cause the second needle to move, thus permitting fuel injection through both sets of outlet openings, the increase in area exposed to fuel pressure once the first needle has been moved away from its seating, not allowing the first needle to return to a closed position. It is thought that, in order to operate in this manner, the rate at which fuel can flow to the first control chamber 40 may have to be increased, rather than relying only on leakage, for example by providing a restricted passage between the supply passage 70 and the control chamber 40.

In order to terminate fuel injection, the first and second control valve arrangements 96, 108 are deactuated such that the valve members 98, 110 seat against their respective valve seatings to prevent high pressure fuel within the first and second control chambers 40, 66 escaping to low pressure. As described previously, the valve needle 12 and the valve needle 13 are therefore returned against their respective seating surfaces 22, 28 and fuel injection ceases.

It will be appreciated that the levels of relatively high and low fuel pressure within the first and second control chambers 44, 66 may not be the same and will be determined by the pressure of the high pressure fuel supply, for example the common rail of a common rail fuel system, and the dimensions of the drillings through which fuel flows into, and escapes from, the first and second control chambers 40, 66.

By providing first and second sets of outlet openings 26, 32 having a different number of openings in each set, or having openings of different size, or having openings with a different fuel spray cone angle, it will be appreciated that by selectively injecting fuel from either the first or second set of outlet openings 26, 32, or both the first and second sets of outlet openings together, the fuel injection characteristics can be varied.

Figure 7:
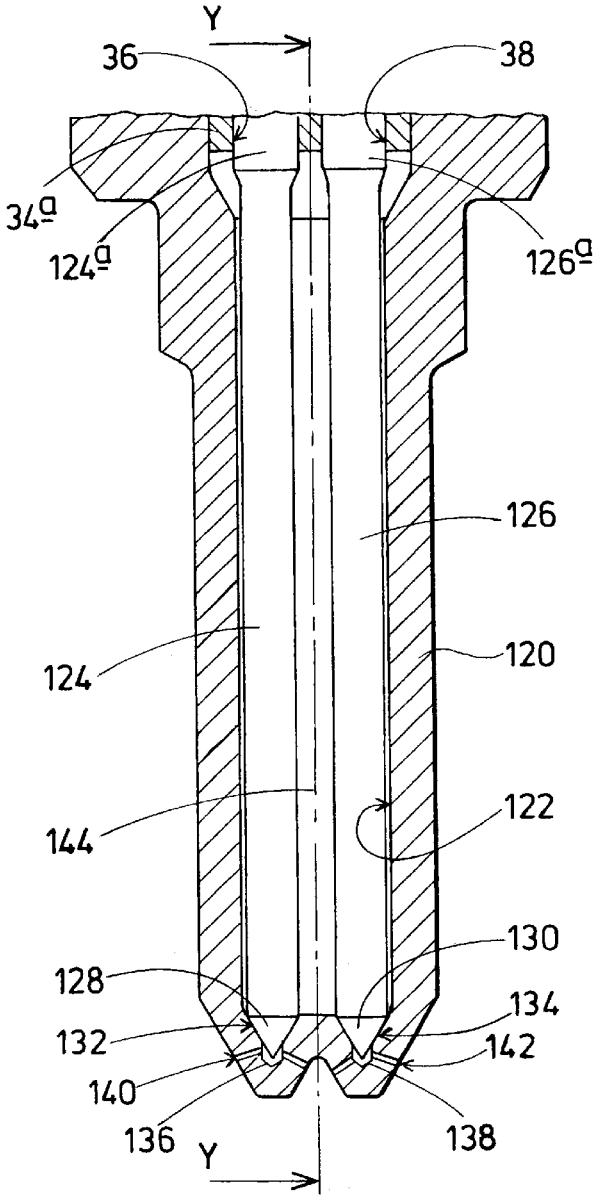
FIG. 7 is a sectional view of an alternative embodiment of the fuel injector of the present invention.
Figure 8:
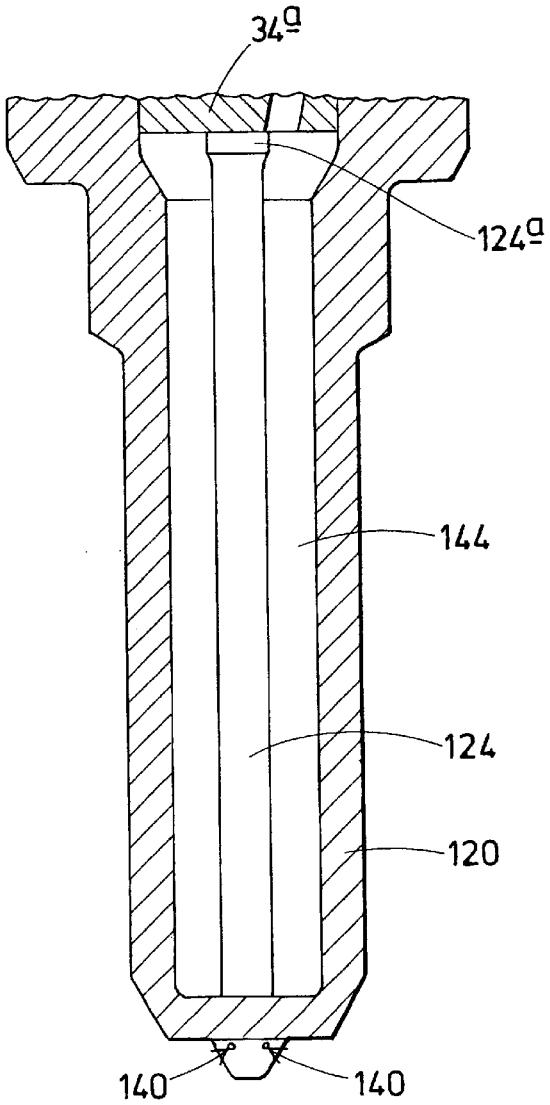
FIG. 8 is a sectional view along line Y—Y of the embodiment in FIG. 7.

Referring to FIGS. 7 and 8, an alternative embodiment of the fuel injector includes a nozzle body 120 provided with a blind bore 122 within which two valve needles 124, 126 are slidable. The valve needles 124, 126 are provided with a tip portions 128, 130 respectively, the blind end of the bore 122 being shaped to define first and second seating surfaces 132, 134 respectively with which the tip portions 128, 130 are engagable to control fuel flow through first and second outlet openings 140, 142 provided in the nozzle body 120. The blind end of the bore 122 is also shaped to define two sac regions 136, 138 located downstream of the first and second seating surfaces 132, 134 respectively, the nozzle body 120 being provided with first and second sets of outlet openings 140, 142 which communicate with the sac regions 136, 138 respectively.

The bore 122 defines a delivery chamber 144 to which fuel is supplied, in use, from a source of fuel at high pressure, as described previously.

The valve needles 124, 126 differ from the valve needles 12, 13 in FIGS. 1–6 in that they only include enlarged diameter regions 124*a*, 126*a* respectively at their uppermost ends, the diameter of the valve needles 124, 126 being substantially the same along the length of the needle between the enlarged end regions 124*a*, 126*a* and the tip portions 128, 130 respectively. Thus, in the embodiment of the invention shown in FIGS. 7 and 8, sliding movement of the valve needles 124, 126 within the bore 122 of the nozzle body is unguided.

The embodiment of the invention shown in FIGS. 7 and 8 is easier to manufacture than the embodiment shown in FIGS. 1 to 6 as the bore 122 has a simplified form. In addition, as the nozzle body 120 is able to be formed with an increased wall thickness, stresses on the nozzle body 120 due to high fuel pressure within the delivery chamber 144 are reduced. However, as sliding movement of the lower ends of the valve needles 124, 126 is unguided, it is preferable to provide first and second outlet openings 140, 142 in communication with the sac regions 136, 138, as opposed to providing outlet openings which are uncovered when the valve needles are moved away from their seatings, to permit fuel delivery therethrough. Control of the fuel injector shown in FIGS. 7 and 8 is achieved in the same way as described previously.

Figure 9:
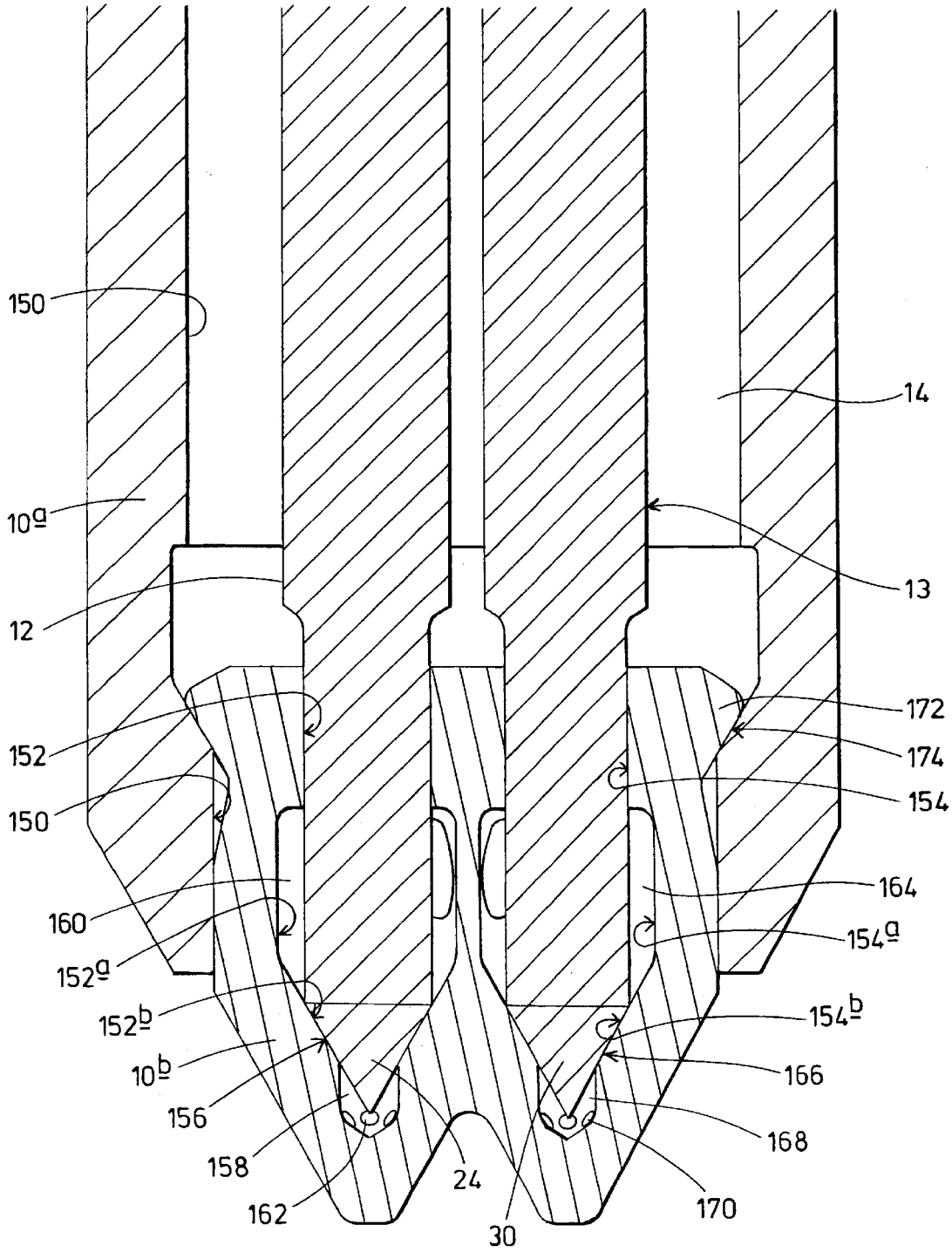
FIG. 9 is a sectional view of a part of a further alternative embodiment of the fuel injector of the present invention.

Referring to FIG. 9, a further alternative embodiment of the invention includes a nozzle body 10 comprising an upper part 10*a* and a lower part 10*b*. The upper part of the nozzle body 10*a* is provided with a through bore 150 and the lower part of the nozzle body 10*b* is provided with two blind bores 152, 154. The through bore 150 includes a region of reduced diameter 150*a* at its lower, open end, the lower part 10*b* of the nozzle body being received within this open end, the outer diameter of the lower part 10*b* being substantially the same as the diameter of the bore region 150*a* such that the lower part 10*b* forms a close fit within the through bore 150. The construction of the upper part 10*a* of the nozzle body at the end remote from the lower part 10*b* is the same as that described previously with reference to FIGS. 1 to 6.

The bore 152 in the lower part 10*b* of the nozzle body includes a region of enlarged diameter 152*a* and a reduced diameter region 152*b* which defines a first seating surface 156, of substantially frusto-conical form, with which the tip portion 24 of the valve needle 12 is engagable. The tip portion 24 extends into a sac region 158 located downstream of the first seating surface 156, the tip portion 24 being engagable with the first seating surface 156 to control fuel flow from a chamber 160, defined by the bore region 152*a* and the sac region 158, the sac region 158 communicating with a first set of outlet openings 162 to permit fuel delivery through the first set of outlet openings 162 when the tip portion 24 is lifted away from the first seating surface 156. Similarly, the bore 154 is provided with a region of enlarged diameter 154*a*, defining a chamber 164, and a region of reduced diameter 154*b* which defines a second seating surface 166, of substantially frusto conical form, with which the tip portion 30 of the valve needle 13 is engagable. The tip portion 30 of the valve needle 13 extends into a second sac region 168 defined within the lower part 10*b* of the nozzle body, the sac region 168 communicating with a second set of outlet openings 170 such that, when the tip portion 30 is lifted away from the second seating surface 166 fuel is able to flow from the chamber 164, into the sac region 168 and out through the second set of outlet openings 170. As described previously, the valve needles 12, 13 are provided with flats, slots or grooves (not shown) which permit, in use, high pressure fuel within the delivery chamber 14 to flow into the chambers 160, 164.

At its end remote from the sac regions 158, 168, the lower part 10*b* of the nozzle body is provided with an annular winged portion 172, the outer surface of which cooperates with a seating 174, of substantially frusto-conical form, defined by the bore 150. The outer diameter of the winged portion 172 and the diameter of the seating 174 are substantially the same so as to form a substantially fluid-tight seal for fuel in the delivery chamber 14. The operation of this embodiment of the invention is the same as described previously, movement of the valve needles 12, 13 being controlled by controlling fuel pressure within the first and second control chambers 40, 66 to permit fuel injection through a selected one or both of the first or second set of outlet openings 162, 170. The embodiment of the invention shown in FIG. 9 provides a manufacturing advantage as the bore 150 can be shaped through its open end. However, as the nozzle body is formed in two parts, the maximum fuel pressure which can be sustained within the delivery chamber 14 is less than that which can be sustained by a fuel injector having an integrally formed nozzle body 10.

Figure 10:
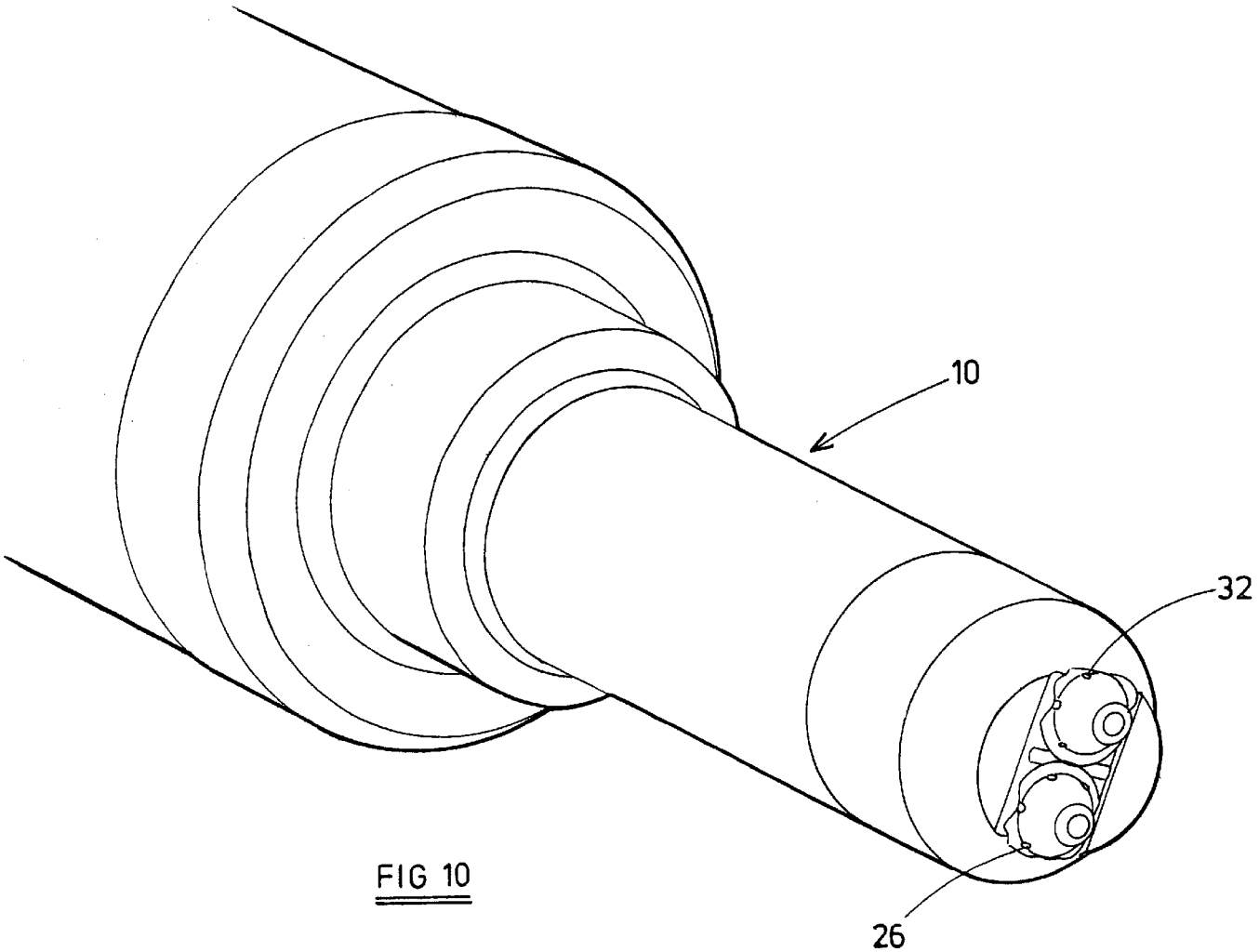
FIG. 10 is a perspective view of the nozzle body forming part of the fuel injector in FIGS. 1–6.

FIG. 10 is a perspective view of an integrally formed nozzle body 10, as shown in FIGS. 1 to 6, illustrating the first and second outlet openings 26, 32. The nozzle body 10 may be ground and milled to provide the required shape or, alternatively, may be cold formed using conventional techniques.

It will be appreciated that the first control chamber 40 and the second control chamber 66 may be supplied with high pressure fuel from different sources. For example, one of the first or second control chambers may be supplied with fuel from an external, second rail as described in European Patent Application No. 00302769.5. Additionally, although the valve needles and the piston members have been shown in the accompanying drawings to extend axially within the fuel injector, it will be appreciated that any of the valve needles or the piston members may be inclined to the axis of the fuel injector, thereby permitting piston members of an increased size to be used if required. For example, in the accompanying drawings, the valve needles 12, 13 and 124, 126 are arranged side by side and in parallel within the bore 11, but for the purpose of the invention the valve needles may be arranged in any way in which they are adjacent to one another as opposed to one being arranged within the other.

Any of the embodiments of the invention described previously may be configured such that the first valve needle 12 is caused to lift away from its seating upon a reduction in fuel pressure within the first control chamber 40 only, rather than requiring fuel pressure within the first control chamber 40 to be reduced followed by a reduction in fuel pressure within the second control chamber 66. For example, with reference to FIG. 3, in order to operate the injector such that movement of the valve needle 12 is effected upon a reduction in fuel pressure within the first control chamber 40 only, the piston member 46 may be arranged to have a diameter which is smaller than the diameter of the valve needle 36. It will also be appreciated that any of the embodiments of the invention may be operated such that only one of the valve needles is moved between an injecting and a non-injecting position. If the injector is to be operated in this manner, fuel pressure within the first control chamber 40 can be maintained at a substantially constant level throughout operation. Only fuel pressure within the second control chamber then needs to be varied so as to control movement of the selected valve needle.

It will be appreciated that a different number of outlet openings to those shown in the accompanying Figures may be provided in the nozzle body.

What is claimed is:

1. A fuel injector comprises:

a nozzle body;

a first bore defined in the nozzle body;

first and second valve needles arranged adjacent to one another;

first and second seatings;

first and second outlet openings provided in the nozzle body; and first and second control chambers for fuel;

wherein the first and second valve needles are slidable within the bore, the first valve needle being engagable with the first seating to control fuel injection from the first outlet opening, the second valve needle being engagable with the second seating to control fuel injection from the second outlet opening; and wherein the first and second control chambers are constructed so that fuel pressure within the first and second control chambers controls movement of the first and second valve needles away from their respective seatings so as to permit fuel delivery from a selected outlet opening.

2. A fuel injector as claimed in claim 1, wherein the first and second valve needles are arranged substantially in parallel within the nozzle body.

3. A fuel injector as claimed in claim 1 constructed so that in use, when fuel pressure within the first and second control chambers is at a relatively high level, the first and second valve needles are biased against their respective seatings such that fuel does not flow through either of said outlet openings.

4. A fuel injector as claimed in claim 1, constructed so that in use when the fuel pressure within the first control chamber is reduced from a relatively high level to a relatively low level, and fuel pressure within the second control chamber is subsequently reduced from a further relatively high level to a further relatively low level, only the first valve needle moves away from its seating.

5. A fuel injector as claimed in claim 4, constructed so that in use, following a reduction in fuel pressure within the first control chamber to the relatively low level and a reduction in fuel pressure within the second control chamber to the further relatively low level, an increase in fuel pressure within the first control chamber to the relatively high level causes the second valve needle to lift away from the second seating.

6. A fuel injector as claimed in claim 1, wherein the nozzle body is provided with a second bore, the first and second bores being arranged side by side and defining flow paths for fuel towards the outlet openings, the first and second valve needles being guided for sliding movement in the first and second bores respectively.

7. A fuel injector as claimed in claim 1, wherein the nozzle body comprises an upper nozzle body part provided with an opening and a lower nozzle body part provided with first and second blind bores arranged side by side, the lower nozzle body part being received in the opening of the first nozzle body part to close an open end thereof, the first and second blind bores receiving a respective one of the first and second valve needles and defining the first and second seatings respectively.

8. A fuel injector as claimed in claim 1, wherein the nozzle body defines a delivery chamber for fuel.

9. A fuel injector as claimed in claim 8, wherein the first and second outlet openings are provided in the nozzle body such that fuel delivery through the first and/or second outlet opening occurs when the first and/or second valve needle moves away from its respective seating.

10. A fuel injector as claimed in claim 8, wherein first and second sac regions are provided downstream of the first and second seatings respectively and upstream of the respective outlet openings, fuel delivery through the first and/or second outlet opening thereby taking place via the respective sac region.

11. A fuel injector comprises:

a nozzle body;

a first bore defined in the nozzle body;

first and second valve needles arranged adjacent to one another;

first and second seatings;

first and second outlet openings provided in the nozzle body; and first and second control chambers for fuel;

wherein the first and second valve needles are slidable with the bore, the first valve needle being engagable with the first seating to control fuel injection from the first outlet opening, the second valve needle being engagable with the second seating to control fuel injection from the second outlet opening;

wherein the first and second control chambers are so constructed so that fuel pressure within the first and second control chambers controls movement of the first and second valve needles away from their respective seatings so as to permit fuel delivery from a selected outlet opening; and, wherein the first control chamber is arranged such that fuel pressure within the first control chamber serves to urge the first valve needle towards the first seating and serves to urge the second valve needle away from the second seating.

12. A fuel injector comprises:

a nozzle body;

a first bore defined in the nozzle body;

first and second valve needles arranged adjacent to one another;

first and second seatings;

first and second outlet openings provided in the nozzle body; and first and second control chambers for fuel;

wherein the first and second valve needles are slidable with the bore, the first valve needle being engagable with the first seating to control fuel injection from the first outlet opening, the second valve needle being engagable with the second seating to control fuel injection from the second outlet opening;

wherein the first and second control chambers are so constructed so that fuel pressure within the first and second control chambers controls movement of the first and second valve needles away from their respective seatings so as to permit fuel delivery from a selected outlet opening; and, wherein the second control chamber serves to urge the first and second valve needles towards their respective seatings.

13. A fuel injector comprises:

a nozzle body;

a first bore defined in the nozzle body;

first and second valve needles arranged adjacent to one another;

first and second seatings;

first and second outlet openings provided in the nozzle body; and first and second control chambers for fuel;

wherein the first and second valve needles are slidable with the bore, the first valve needle being engagable with the first seating to control fuel injection from the first outlet opening, the second valve needle being engagable with the second seating to control fuel injection from the second outlet opening;

wherein the first and second control chambers are so constructed so that fuel pressure within the first and second control chambers controls movement of the first and second valve needles away from their respective seatings so as to permit fuel delivery from a selected outlet opening; and, wherein the fuel injector is constructed so that in use, when the fuel pressure within the first control chamber is at a relatively high level and fuel pressure within the second control chamber is reduced from a further relatively high level to a further relatively low level, only the second valve needle moves away from its seating to allow fuel to flow through the second outlet opening only.

14. A fuel injector as claimed in claim 13 constructed so that in use when the second valve needle is lifted away from the second seating with fuel pressure within the first control chamber at the relatively high level, a reduction in fuel pressure within the first control chamber from the relatively high level to a relatively low level also causes the first valve needle to move away from the seating.

15. A fuel injector comprises:

a nozzle body having a bore and defining a chamber, the chamber having first and second seatings, at least one first outlet opening located near the first seating and at least one second outlet opening located near the second seating; and, first and second valve needles located within the bore, the first and second valve needles being slidable with the bore, the first valve needle being engagable with the first seating to control fuel injection from the chamber though the first outlet opening, the second valve needle being engagable with the second seating to control fuel injection from the chamber through the second outlet opening.

16. A fuel injector, as set forth in claim 15, including first and second control chambers for fuel located within the nozzle body.

17. A fuel injector, as set forth in claim 16, wherein the first and second control chambers are so constructed so that fuel pressure within the first and second control chambers controls movement of the first and second valve needles away from their respective seatings so as to permit fuel delivery from a selected outlet opening.

* * * * *